United States Patent [19]

Liberacki

[11] 4,257,393

[45] Mar. 24, 1981

[54] VENTING SYSTEM FOR A FUEL-BURNING HEATING PLANT

[75] Inventor: Barry D. Liberacki, Downers Grove, Ill.

[73] Assignee: Energy Marketing, Inc., Downers Grove, Ill.

[21] Appl. No.: 61,280

[22] Filed: Jul. 27, 1979

[51] Int. Cl.[3] ..... F23J 11/02

[52] U.S. Cl. ..... 126/307 A; 98/48; 110/147; 110/322; 431/20

[58] Field of Search ..... 126/307 R, 307 A, 312; 98/48; 110/203, 322, 323, 147, 163, 184, 325, 326; 431/20

[56] References Cited

U.S. PATENT DOCUMENTS

| | | | |
|---|---|---|---|
| 2,257,240 | 9/1941 | Livar | 126/307 A |
| 4,009,705 | 3/1977 | Smith | 126/307 A |
| 4,079,727 | 3/1978 | Smith | 126/307 A |
| 4,187,833 | 2/1980 | Zahora et al. | 126/307 A X |

*Primary Examiner*—Edward G. Favors
*Attorney, Agent, or Firm*—Lee & Smith

[57] ABSTRACT

A venting system for a fuel-burning heating plant, such as a conventional gas-fired furnace. The venting system includes an open-bottomed diverter situated well above the base of the heating plant having vertically disposed inlet and outlet ducts attached to the diverter top. The inlet duct is also attached to the flue outlet of the furnace, while the outlet duct is attached to a chimney flue for expulsion of combustion gases. A heat retention means, such as a damper or a heat-absorbing cone, is located within the inlet duct to permit absorption of heat from passing combustion gases during the combustion cycle and maintain heat in the inlet duct during cessation of the combustion cycle in order to establish a heat lock within the inlet duct and the diverter to prevent the flow of relatively cooler air through the furnace combustion chamber and up the chimney during cessation of the combustion cycle. A similar heat retention means may also be located within the outlet duct.

15 Claims, 5 Drawing Figures

30
34
32
42
40
16
66
14
48
46
3.
3.
50
58
52
52
50
74
54
56
76
68
62
10
70
22
28
28
12
60
18
72
20
24
24
26
29

14
18
48
22
20
46
62
76
16
62
56
76
58
10
70
29
66
29
74
54
62
76

VENTING SYSTEM FOR A FUEL-BURNING HEATING PLANT

DESCRIPTION

Background Of The Invention

This invention relates to venting systems for a fuel-burning heating plant, such as a gas-fired furnace, and relates in particular to a venting system which establishes a heat lock during the off cycle of the furnace in order to substantially increase the furnace efficiency.

Due to historically low fuel costs, common heating plants have, in the past, been quite fuel inefficient. A typical such plant includes a combustion chamber, where fuel is consumed with air drawn through an air inlet port to heat a heat transfer area, and an outlet where combustion gases are vented to the atmosphere through a chimney flue. Depending on the desired temperature within the heat transfer area, the combustion chamber is periodically activated to maintain that temperature. During the "off" cycle, that period when the combustion chamber is not activated, the heating plant presents no inhibition to air flow, and therefore, due to convection, cooler air continues to be drawn through the inlet port into the combustion chamber, where it is heated, and then up the chimney, where it is expelled to the atmosphere. Thus, the continual air flow prematurely cools the heat transfer area, forcing the combustion chamber to be activated more often than necessary.

With the increasing scarcity of energy, and corresponding increasing costs, it is important that fuel-burning heating plants be made as efficient as possible in order to conserve fuel and reduce operating costs per unit of energy delivered for ultimate use. Much prior activity has been directed toward heat conservation by means of a damper in the heating plant outlet flue, as exemplified by U.S. Pat. Nos. 1,743,731; 1,773,585; 1,875,616; 1,959,970; and 4,017,024.

U.S. Pat. Nos. 4,009,705 and 4,079,727 disclose venting systems for a heating plant which omit the damper systems of the above patents, and in their place substitute venting systems which are constructed to establish a heat lock in the outlet flue in order to prevent flow of relatively cooler air through the combustion chamber during the off cycle of the plant. A substantial disadvantage of the systems of these two patents is, however, that the heat lock lasts for a relatively short period of time, so that if the combustion chamber is off for more than a few minutes, the heat lock is dissipated and cooler air is allowed to begin normal convection through the combustion chamber, where it is heated, and out the chimney, prematurely cooling the heat transfer device. Such heat is lost, decreasing the efficiency of the heating plant. In addition, the venting systems of these two patents have no means of preventing warm room air from escaping directly up the chimney flue, or for preventing flue down drafts. Additional efficiency is therefore lost.

It is known to provide a flue wth a diverter, as exemplified by U.S. Pat. Nos. 656,989; 1,970,488; 2,031,314; and 2,385,450. While each serves to divert flue down drafts, typically to avoid extinguishing a pilot light, none serves to increase heating plant efficiency by preventing the escape of air up the chimney flue during the combustion off cycle, thus allowing relatively cooler air to flow into and cool the combustion chamber.

SUMMARY OF THE INVENTION

The present invention avoids the noted deficiencies of the prior art and others by providing a venting system for a fuel-burning heating plant which prevent the passage of relatively cooler air through the furnace combustion chamber during the period that the furnace combustion chamber is not being activated. The system includes an open-bottomed diverter having a vertically disposed inlet duct attached to the diverter and extends upwardly to engage a flue outlet from the combustion chamber of the heating plant. An outlet duct extends upwardly from the diverter and is connected to a chimney flue for expulsion of combustion gases from the heating plant.

Within the inlet duct, a heat retention device permits absorption by the venting system of heat from passing combustion gases during the combustion cycle of the heating plant, and maintains heat in the inlet duct during the off cycle in order to establish a heat lock within the inlet duct and diverter, thus preventing the flow of relatively cooler air through the combustion chamber during the off cycle.

There is sufficient passage space between the heat retention means and the inlet duct during the combustion cycle in order to permit the flow of combustion gases past the heat retention means. Preferably, the cross-sectional area of such passage is at least as great as the minimum cross-sectional area of the flue outlet sufficient for removal of combustion gases from the combustion chamber during the combustion cycle.

To prevent heat transfer from the inlet duct to the outlet duct, the two ducts are separated. In addition, the inlet duct may be insulated to further prevent heat loss.

The heat retention means may comprise either a heat absorbing device, such as a cone situated within the inlet duct, or a heat blocking device such as a damper, also situated within the inlet duct. The cone is composed of heat absorbing material, such as metal, and is oriented to impede the normal flow of combustion gases as little as possible. The damper, which may be electrically or mechanically actuated, or which may be finely balanced, is of sufficient size to close the inlet during cessation of the combustion cycle, and opens during the combustion cycle to allow by-passage of combustion gases.

In order to further increase furnace efficiency, a heat retention means may be situated in the outlet duct as well. This heat retention means may again comprise either a heat absorbing cone or a damper.

BRIEF DESCRIPTION OF THE DRAWINGS

The invention is described in greater detail below in conjunction with the drawings, in which.

DESCRIPTION OF THE PREFERRED EMBODIMENTS

Figure 2:
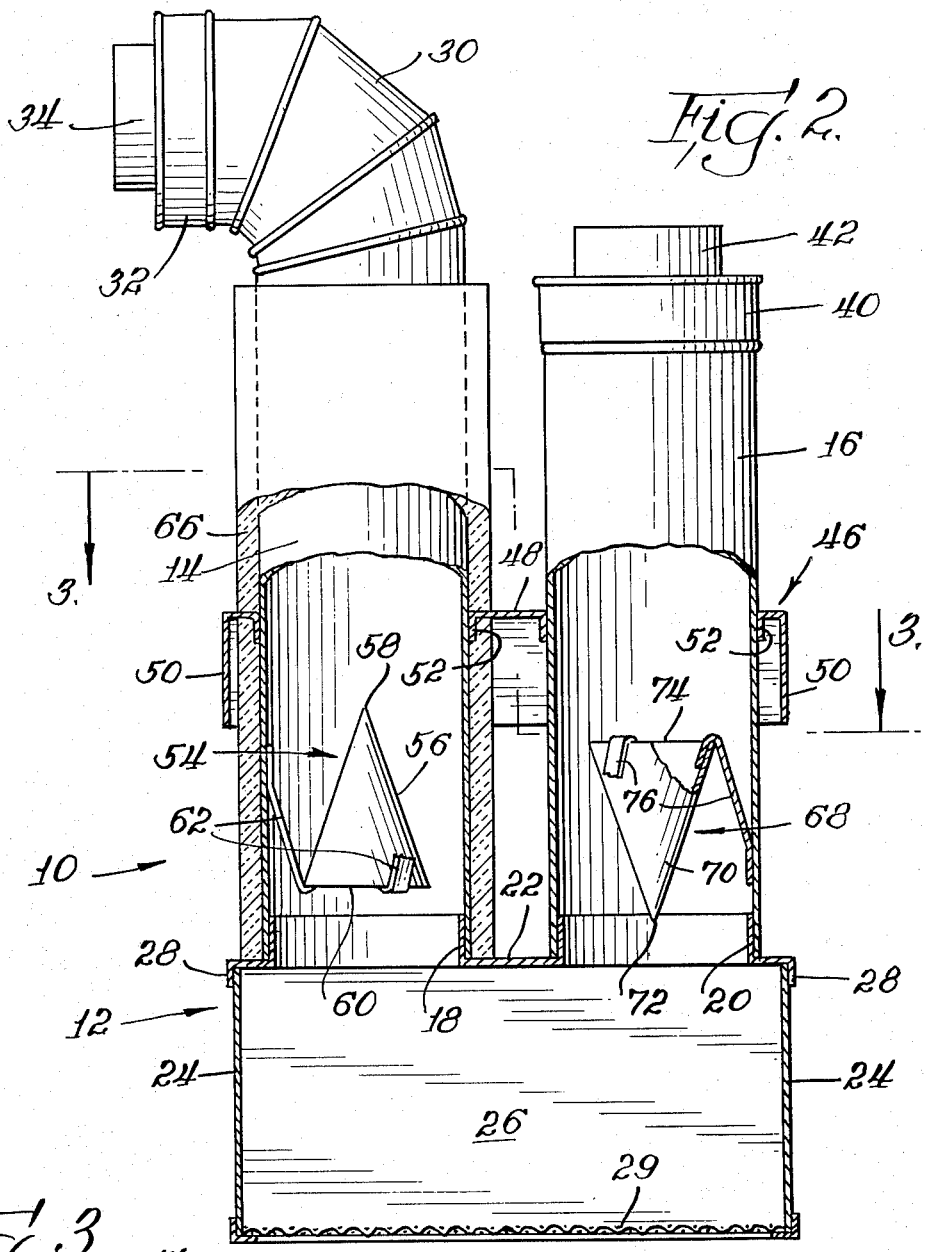
FIG. 2 is an enlarged partial sectional illustration of the venting system shown in FIG. 1.

In the drawings, the venting system 10 is composed of three primary elements, an open-bottomed diverter 12, a vertically disposed inlet duct 14 and a vertically disposed outlet duct 16. Each of the ducts 14 and 16 is securely attached to respective collars 18 and 20 formed in the top of the diverter 12, as shown in FIG. 2. The collars 18 and 20 define openings to the diverter 12. The ducts 14 and 16 are separated by appropriate spacing of the collars 18 and 20. Thus, there can be little direct heat transfer between the duct 14 and the duct 16.

Figure 3:
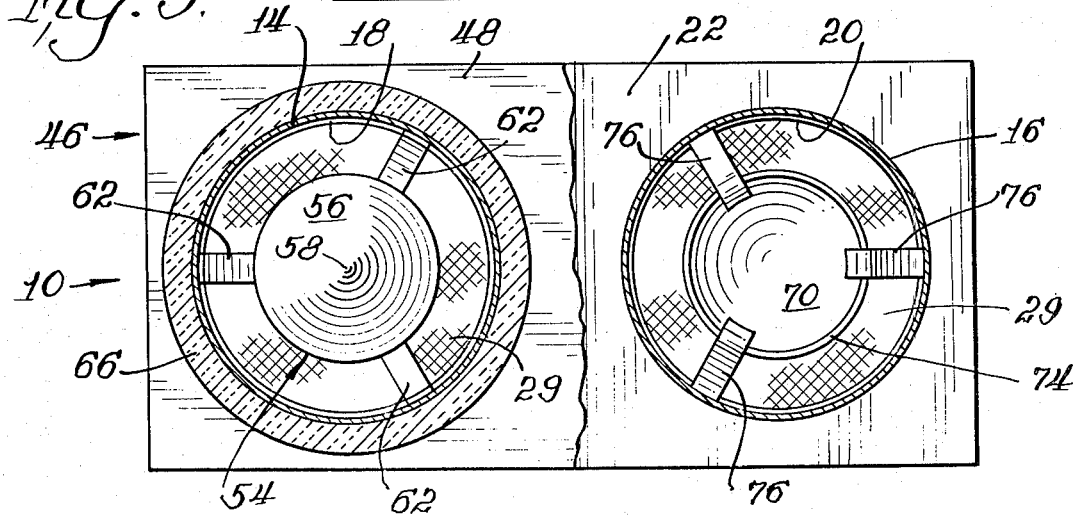
FIG. 3 is a cross-sectional illustration taken along lines 3—3 of FIG. 2.

As best shown in FIGS. 2 and 3, the diverter 12 is a rectangular structure having a top plate 22, closed ends 24 and closed sides 26. At respective junctures, the ends 24 and sides 26 are sealed to prevent leakage of combustion gases from the diverter 12. Preferably, this is accomplished by formation of the ends 24 and sides 26 from a single piece of sheet metal which is bent to the appropriate shape. Likewise, the juncture of the ends 24 and sides 26 to the top plate 22 is also sealed to prevent escape of flue gases. The top plate 22 may include a perimeter flange 28 to which the ends 24 and sides are attached by appropriate fasteners (not illustrated), or the ends and sides may be affixed to the top plate by any suitable means.

The bottom of the diverter 12 is open, as illustrated, to permit in-flow of ambient air to aid expulsion of combustion gases. If desired, a screen 29 may be used to prevent access to the interior of the diverter or the ducts 14 and 16.

Figure 1:
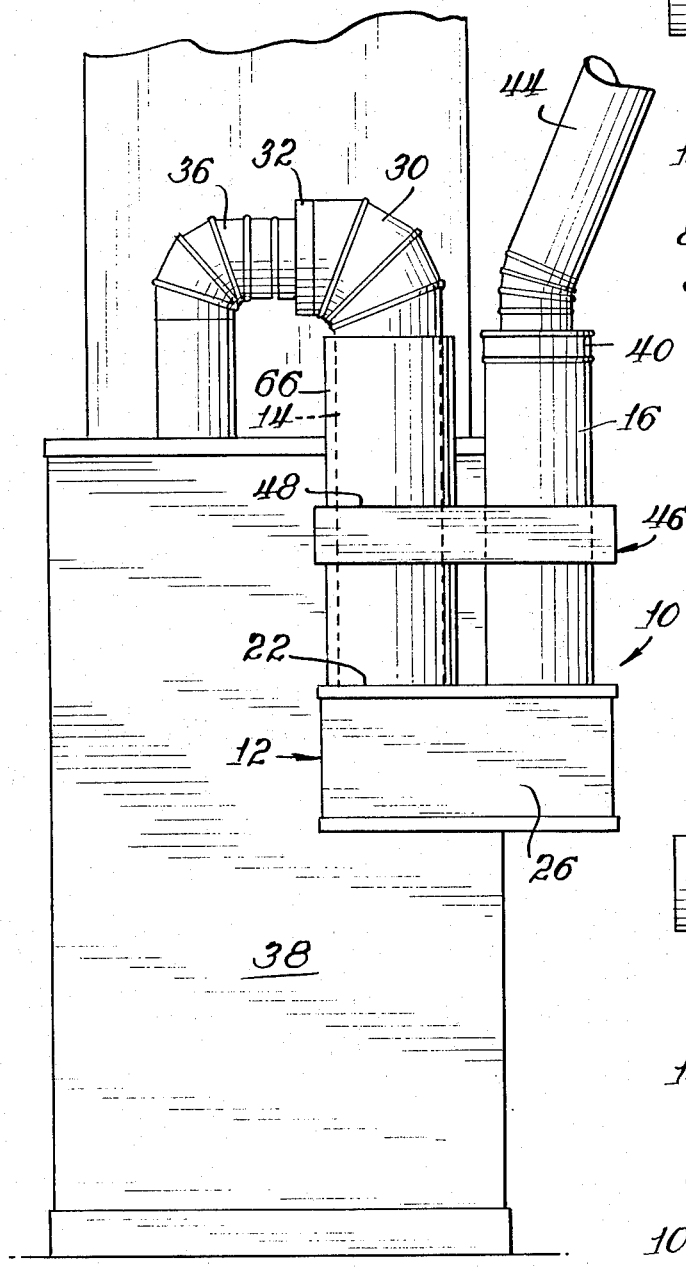
FIG. 1 is an elevational view of a furnace employing the venting system according to the invention.

As best shown in FIGS. 1 and 2, the inlet 14 includes an elbow 30 capped by a reducing flange 32 which has a reduced inlet 34 of sufficient size to mate with the outlet flue 36 emanating from the combustion chamber (not illustrated) of a heating plant 38. The heating plant 38 may be any typical fuel-burning heating plant, such as a furnace, boiler or hot water heater. The flue 36 is of a smaller dimension that the internal dimension of the inlet 14, for reasons which will be described in greater detail below.

To assure proper flowage of combustion gases, the open bottom of the diverter 12 must be well above the base of the heating plant 38. As will be evident, if the bottom of the diverter is below the level of the combustion chamber, combustion gases will tend to back up within the heating plant, posing the likelihood of escape of deadly gases to the environment about the heating plant. Hence, the location of the diverter 12 relative to the heating plant 38 must be carefully selected.

The outlet 16 is capped with a reducing flange 40 which is similar to the reducing flange 32. The flange 40 includes a reduced outlet 42 of sufficient size to mate with a chimney flue 44 (FIG. 1) leading to the exterior for expulsion of combustion gases from the heating plant 38.

In order to rigidify the system and maintain spacing between the inlet duct 14 and the outlet duct 16, the system perferably includes a support 46 extending between and attached to the inlet and outlet ducts. While the support 46 may be composed of any suitable structure, the embodiment shown in the drawings is comprised of a rigid plate 48 having integral strengthening flanges 50 extending about the outer periphery. As shown in FIG. 2, the plate 48 includes a pair of apertures shaped to accommodate passage of the respective inlet duct 14 and outlet duct 16. To simplify attachment of the support 46 to the ducts 14 and 16, each aperture in the plate 48 includes an integral circumferential flange 52 which may be bolted, welded, or otherwise affixed to the respective ducts 14 and 16.

As explained in above-identified U.S. Pat. Nos. 4,009,705 and 4,079,727, the diverter 12, in combination with the inlet duct 14, forms a heat lock when the combustion chamber of the heating plant 38 is unactivated in order to prevent relatively cooler ambient air from entering the air intake (not illustrated ) of the heating plant 38, cooling the heat transfer area of the heating plant, and subsequently passing as waste heat out the chimney flue 44. However, the systems of U.S. Pat. Nos. 4,009,705 and 4,079,727 maintain a heat lock for only a relatively short period of time. As time progresses, the diverter of such systems cools rapidly, and the heat lock is correspondingly rapidly dissipated, until such time as the heat lock is eliminated and ambient air is allowed to be drawn through the heating plant during the off cycle.

In order to maintain the heat lock for as long as necessary, the present invention includes a heat retention means 54 located within the inlet duct 14. As shown in FIG. 2, the heat retention means comprises a heat absorbing cone 56. The cone 56 is oriented with its tip 58 aimed in the direction of incoming combustion gases passing through the inlet duct 14, and with its base 60 directed toward the diverter 12. A series of straps 62, appropriately fastened to the cone 56 and the inside wall of the inlet duct 14 (means not illustrated), orient the cone centrally within the inlet duct. The straps 62 may be metal strips, as illustrated, or wire or any suitable material of sufficient strength and rigidity to maintain the cone 56 in a proper orientation within the inlet duct 14.

The cone 56 can be formed of any material capable of absorbing heat during the heating plant combustion cycle and then emit heat during the off cycle. The cone may be solid or hollow, and is oriented, as illustrated to present as little impedence as possible to combustion gases normally flowing down the inlet duct 14 to the diverter 12, but provides high impedence to reverse flow of gases.

As is well known, the combustion chamber of any heating plant, such as that of the heating plant 38 shown in FIG. 1, must have a flue outlet in order to withdraw and dispel combustion gases created within the combustion chamber when it is fired. For a combustion chamber of a particular capacity, there is a minimum cross-sectional area of the flue outlet sufficient for proper removal of combustion gases from the combustion chamber. It is important that this minimum area be maintained throughout the flue outlet and/or chimney flue in order to avoid build up of gases within the system. Hence, as shown in FIG. 2, there is a passage 64 between the base 60 of the cone 56 and the interior wall of the inlet duct 14. The cross-sectional area of the passage 64 must be at least as great as the minimum cross-sectional area of the flue outlet from the combustion chamber in order to avoid gaseous build up, as previously explained. Thus, as shown in FIG. 1, the outlet flue 36 is of a smaller dimension than the inlet duct 14. The duct 14 is of a sufficient size so that the cross-sectional area of the passage 64 is no less than the cross-sectional area of the outlet flue 36. Alternatively, the inlet duct 14 could be expanded only in the vicinity of the cone 56, the remainder being of the same internal area as that of the outlet flue 36, thereby eliminating the need for the reducer 32.

In order to assure retention of heat within the diverter 12 and inlet duct 14 for as long as possible during the off cycle, the inlet is preferably encased in insulation 66. The insulation 66, which is composed of any suitable, non-combustible material, encases as much of the inlet 14 as possible to retain heat within the inlet duct 14, and also prevents direct transfer of heat from the inlet duct 14 to the outlet duct 16.

As best shown in FIG. 2, preferably a second heat retention means 68 is located within the outlet duct 16. As in the inlet duct 14, the heat retention means 68 comprises a heat absorbing cone 70 having a tip 72 oriented toward the diverter 12 in the direction of the flow of combustion gases, and a base 74 slanted away from the diverter 12. A series of straps 76 are employed to situate the cone 70 centrally within the outlet duct 16. The area between the base 74 of the cone 70 and the wall of the outlet duct 16 defines a passage 78 for the outflow of combustion gases passed the cone 70. Again, the minimum cross-sectional area of the passage 78 must be at least as great as the minimum cross-sectional area of the outlet flue 36 in order to avoid the build up of combustion gases within the diverter 12, and possible spillage of the gases into the surrounding environment through the open bottom. The cone 70 is shaped and oriented to present as little impedence as possible to normal flow up the outlet duct 16, but presents high impedence to reverse flow.

In operation, the venting system of FIGS. 1 through 3 operates as follows. During the combustion cycle of the heating plant 38, combustion gases exit the combustion chamber through the outlet flue 36. The combustion gases pass into the inlet duct 14 and travel downward in the inlet duct, passing and heating the cone 56. The gases then travel into the diverter 12, reverse direction and pass upwardly into the outlet duct 16 while heating the cone 70. The combustion gases are expelled to the atmosphere by the chimney flue 44. As a draft aid, cooler ambient air also enters the bottom of diverter 12, mixing with the combustion gases and exiting with the combustion gases through the outlet duct 16.

During the off cycle, hot air is captured in the inlet duct 14, preventing continued air flow from the heating plant 38 through the venting system 10. The cone 56 radiates heat to its surrounding environment to maintain the elevated temperature of the inlet duct 14. At the same time, the cone 70, if present, also maintains the outlet 16 at an elevated temperature, maintaining a heat lock within the outlet duct as well. Thereafter, when the combustion cycle is reinitiated, combustion gases immediately begin to flow through the venting system as described above, and the cones 56 and 70 are reheated to be ready to reestablish the heat lock during the next off cycle.

Figure 4:
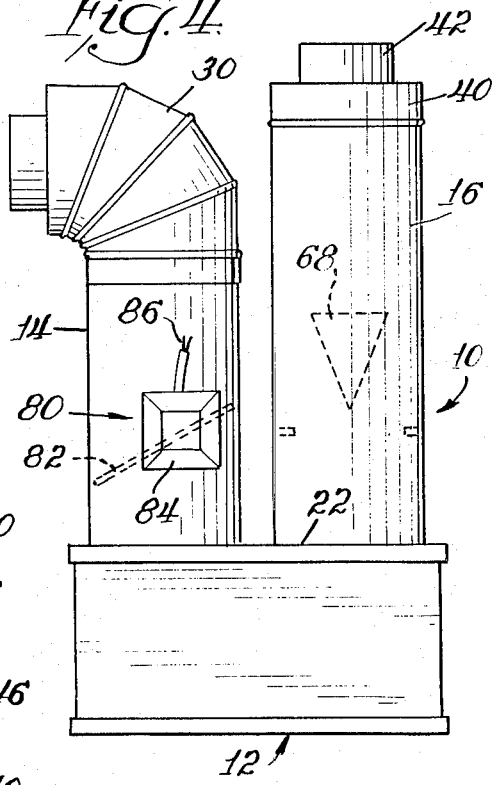
FIG. 4 is an elevational view of an alternative embodiment of the invention.

An alternative embodiment of the invention is shown in FIG. 4. In this embodiment, the heat retention means 54 of FIG. 2 has been replaced by a heat retention means 80 comprised of a damper 82 (shown in the closed position) and a control 84 which functions to maintain the damper 82 open during the combustion cycle and close the damper during the off cycle. The particular control 84 illustrated is an electrical control having wires 86 connected to the heating plant control (not illustrated) so that when the combustion chamber is activated by the heating plant control, electrical signals are directed by the heating plant control to activate the control 84 to open the damper 82 and, upon cessation of combustion within the combustion chamber, activate the control 84 to close the damper 82. Hence, the damper 82, in the closed position, provides a positive lock to prevent cooler air from flowing through the heating plant 38 during the off cycle. The remaining portions of the system 10 function as described above with regard to FIGS. 1 through 3.

Figure 5:
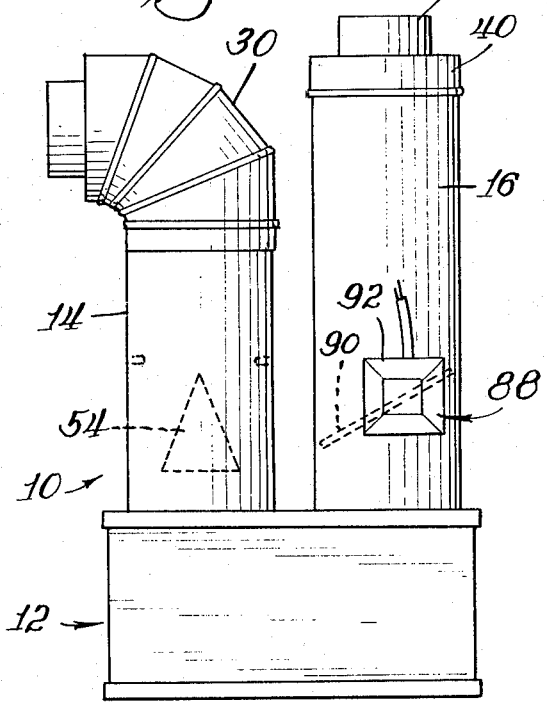
FIG. 5 is an elevational view of a second alternative embodiment of the invention.

A second alternative embodiment of the invention is illustrated in FIG. 5. In this embodiment, the heat retention means 68 of FIG. 2 has been replaced by a heat retention means 88 composed of a damper 90 actuated by a control 92. The heat retention means 88 is identical to, and functions in the same manner as, the heat retention means 80 of FIG. 4. All other portions of the system illustrated in FIG. 5 function in the same manner as that described above with regard to FIGS. 1 through 3.

Other changes and alternative constructions can be embodied in the venting system 10. For example, rather than employment of a damper replacing only one of the heat retention cones 56 or 70, as shown in FIGS. 4 and 5, both of the cones can be replaced by dampers. In addition, the dampers can be mechanically operated rather than electrically operated, or can be finely balanced in order to react to air flow and open when required.

Various other changes can also be made. As an example, the locations of the ducts 14 and 16 in the diverter 12 can be changed, so long as the respective functions of the ducts are not altered and their separation is maintained. Also, the elbow 30 may be eliminated depending on the orientation of the outlet flue from the heating plant. Various other changes may be made to the invention without departing from the spirit thereof or scope of the following claims.

What is claimed is:

1. In a venting system for a heating plant, the heating plant having a periodically activated combustion chamber, a combustion air inlet and a flue outlet having a minimum cross-sectional area sufficient for removal of combustion gases from the combustion chamber during the combustion cycle, and the venting system having an open-bottomed diverter, a vertically disposed inlet duct attached to the diverter and connected to the flue outlet, and an upwardly extending outlet duct attached to and extending from the diverter, the outlet duct being connected to a chimney flue for expulsion of combustion gases from the heating plant, the improvement comprising:

a. heat-retention means located within the inlet duct for permitting absorption of heat from passing combustion gases during the combustion cycle and maintaining heat in the inlet duct during cessation of the combustion cycle to establish a heat lock within the inlet duct and diverter to prevent the flow of relatively cooler air through the combustion air inlet and into the combustion chamber during such cessation, b. a passage between said heat-retention means and said inlet duct during the combustion cycle to permit flow of combustion gases past said heat retention means, the cross-sectional area of said passage being at least as great as said minimum cross-sectional area of the flue outlet, and c. means spacing said inlet duct from said outlet duct to substantially eliminate direct heat transfer from said inlet duct to said outlet duct.

2. A venting system according to claim 1 in which said heat retention means comprises a heat absorbing device, which device absorbs heat from passing combustion gases during the combustion cycle and releases heat to the inlet duct during cessation of the combustion cycle to maintain the temperature of the inlet duct and reinforce the heat lock.

3. A venting system according to claim 2 in which said heat absorbing device comprises a cone situated within said inlet duct immediately adjacent said diverter, said cone having a base proximate said diverter and a tip oriented away from said diverter, and means suspending said cone within said inlet duct.

4. A venting system according to claim 3 in which said suspending means comprises at least one strap extending between said cone and said inlet duct.

5. A venting system according to claim 1 in which said heat-retention means comprises a damper of sufficient dimension to close said inlet duct to prevent flow of gases, and including means to maintain the damper opened during the combustion cycle and to close the damper during cessation of the combustion cycle.

6. A venting system according to claim 1 including a second heat-retention means located within the outlet duct for permitting absorption of heat from passing combustion gases during the combustion cycle and maintaining heat in the outlet duct during cessation of the combustion cycle to establish a heat lock within the outlet duct.

7. A venting system according to claim 6 in which said second heat-retention means comprises a second heat absorbing device, which device absorbs heat from passing combustion gases during the combustion cycle and releases heat to the outlet duct during cessation of the combustion cycle.

8. A venting system according to claim 7 in which said second heat absorbing device comprises a second cone situated within said outlet duct immediately adjacent said diverter, said second cone having a tip proximate said diverter and a base oriented away from said diverter, and means suspending said second cone within said outlet duct.

9. A venting system according to claim 6 in which said second heat-retention means comprises a damper of sufficient dimention to close said outlet duct to prevent flow of gases, and including means to maintain the damper opened during the combustion cycle and to close the damper during cessation of the combustion cycle.

10. A venting system according to claim 5 or 9 in which said means to maintain comprises an electrical control responsive to activation of the combustion chamber.

11. A venting system according to claim 1 including a support extending between and attached to the inlet duct and the outlet duct to rigidify the venting system.

12. A venting system according to claim 11 in which said support includes a flat plate having a pair of apertures therein shaped to accomodate passage of said inlet and outlet ducts.

13. A venting system according to claim 1 in which said means spacing comprises an air gap between said inlet and outlet ducts created by attachment of said ducts to diverse locations on the diverter.

14. A venting system according to claim 13 including a support extending between and attached to said inlet and outlet ducts to maintain said air gap.

15. A venting system according to claim 1 including means insulating said inlet duct to substantially prevent heat loss therefrom.

* * * * *